US008385757B2

(12) United States Patent
Sugano

(10) Patent No.: US 8,385,757 B2
(45) Date of Patent: Feb. 26, 2013

(54) TEMPERATURE CONTROL IN IMAGE FORMING APPARATUS

(75) Inventor: Michio Sugano, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 263 days.

(21) Appl. No.: 12/964,490

(22) Filed: Dec. 9, 2010

(65) Prior Publication Data

US 2011/0142460 A1 Jun. 16, 2011

(30) Foreign Application Priority Data

Dec. 14, 2009 (JP) ..... 2009-283457

(51) Int. Cl.
*G03G 15/00* (2006.01)

(52) U.S. Cl. ..... 399/44

(58) Field of Classification Search ..... 399/44, 399/43, 38

See application file for complete search history.

(56) References Cited

U.S. PATENT DOCUMENTS

| | | | |
|---|---|---|---|
| 7,315,702 B2 | 1/2008 | Takayanagi | |
| 7,593,659 B2 | 9/2009 | Takayanagi | |
| 7,725,050 B2 * | 5/2010 | Li et al. | |
| 2004/0126124 A1 * | 7/2004 | Inoue et al. | 399/44 |
| 2008/0298827 A1 | 12/2008 | Akiyama et al. | |

FOREIGN PATENT DOCUMENTS

| | | | |
|---|---|---|---|
| JP | 6-194921 A | | 7/1994 |
| JP | 2003-149998 A | | 5/2003 |
| JP | 2005-156758 A | | 6/2005 |
| JP | 2005-315966 A | | 11/2005 |
| JP | 2006119527 A | * | 5/2006 |
| JP | 2008-90219 A | | 4/2008 |
| JP | 2008-246768 A | | 10/2008 |
| JP | 2008-296473 A | | 12/2008 |
| JP | 2009-109874 A | | 5/2009 |

* cited by examiner

*Primary Examiner* — Susan Lee
(74) *Attorney, Agent, or Firm* — Canon USA, Inc., IP Division

(57) ABSTRACT

An image forming apparatus includes a reception unit, an image forming unit, a drive unit, a detection unit, a prediction unit, and a control unit. The image forming unit forms an image based on image information received by the reception unit. The drive unit controls an imaging forming unit drive. The detection unit detects temperature within the image forming apparatus. The prediction unit predicts a transition of temperature within the image forming apparatus and an image formation time based on the image information and the temperature within the image formation unit. The control unit is responsive to detected temperature and predicted image forming time. The control unit switches between image forming modes and controls the image forming apparatus to form an image in a short image forming time.

3 Claims, 18 Drawing Sheets

FIG.8A

[A CASE WHERE PRINT TIME IS SHORTER WHEN SPEED CHANGE IS EXECUTED]

| | PRINT SPEED (page/min) | COEF | CONVERGENCE TEMPERATURE (C°) | TEMPERATURE RISE LIMIT (C°) | PRINT START-TIME ENVIRONMENT TEMPERATURE (C°) | NUMBER OF PRINTED PAGES (page) |
|---|---|---|---|---|---|---|
| OPERATION STATUS A | Sa | k1 | Cx1 | Cmax | Cstart | P1 |
| OPERATION STATUS B | Sb | k2 | Cx2 | | | |

FIG.8B

| RESULT | PRINT TIME (min) |
|---|---|
| WITH SPEED CHANGE | t1 |
| WITH COOLING | t2 |

FIG.10A

[A CASE WHERE PRINT TIME IS SHORTER WHEN COOLING MODE IS EXECUTED]

| | PRINT SPEED (page/min) | COEF | CONVERGENCE TEMPERATURE (C°) | TEMPERATURE RISE LIMIT (C°) | PRINT START-TIME ENVIRONMENT TEMPERATURE (C°) | NUMBER OF PRINTED PAGES (page) |
|---|---|---|---|---|---|---|
| OPERATION STATUS A | Sa | k1 | Cx1 | Cmax | Cstart | P2 |
| OPERATION STATUS B | Sb | k2 | Cx4 | | | |

FIG.10B

| RESULT | PRINT TIME (min) |
|---|---|
| WITH SPEED CHANGE | t3 |
| WITH COOLING | t4 |

| ORDER OF PRINT JOBS | JOB NUMBER | PRINT CONDITIONS | PREDICTED JOB END TIME |
|---|---|---|---|
| 1 | 1 | · · · | a |
| 2 | 2 | · · · | a+b |
| 3 | · | · · · | a+b+c |
| · | · | · · · | · · · |
| · | · | · · · | · · · |
| Id | n | · · · | a+b+c ··· +x |

| ORDER OF PRINT JOBS | JOB NUMBER | PRINT CONDITIONS | PREDICTED JOB END TIME |
|---|---|---|---|
| 1 | 1 | · · · | a |
| 2 | 2 | · · · | a+b |
| 3 | · | · · · | a+b+c |
| · | · | · · · | · · · |
| · | · | · · · | · · · |
| Id | n | · · · | a+b+c ··· +x |

EACH PREDICTED JOB END TIME INCLUDES COOLING TIME TO COOL INTERIOR TEMPERATURE OF APPARATUS

FIG.13

BUFFER FOR CALCULATING JOB END TIME (CALCULATION BUFFER)

| ORDER OF PRINT JOBS | JOB NUMBER | PRINT CONDITIONS | PREDICTED JOB END TIME |
|---|---|---|---|
| 1 | 1 | · · · | a |
| 2 | 2 | · · · | a+b |
| 3 | 3 | · · · | a+b+c |
| · | · | · · · | · · · |
| · | · | · · · | · · · |
| ld | n | · · · | a+b+c ··· +x=t4 |

PERMUTATE JOB NUMBERS 2 AND 3

BUFFER FOR CALCULATING JOB END TIME (CALCULATION BUFFER)

| ORDER OF PRINT JOBS | JOB NUMBER | PRINT CONDITIONS | PREDICTED JOB END TIME |
|---|---|---|---|
| 1 | 1 | · · · | a |
| 2 | 3 | · · · | a+m |
| 3 | 2 | · · · | a+m+n |
| · | · | · · · | · · · |
| · | · | · · · | · · · |
| ld | n | · · · | a+m+n ··· +x=t3 |

IF t3 < t4, ORDER OF JOB NUMBERS IS STORED FROM SHORTEST PRINT TIME IN BUFFER FOR PRINT EXECUTION

BUFFER FOR STORAGE OF PRINT EXECUTION ORDER (EXECUTION BUFFER)

| ORDER OF PRINT JOBS | JOB NUMBER |
|---|---|
| 1 | 1 |
| 2 | 3 |
| 3 | 2 |
| · | · |
| · | · |
| ld | n |
| JOB END TIME | t3 |

FIG.16A

[A CASE WHERE PRINT TIME IS SHORTER WHEN JOBS ARE PERMUTATED]

| | PRINT SPEED (page/min) | COEF | CONVERGENCE TEMPERATURE (C°) | TEMPERATURE RISE LIMIT (C°) | PRINT START-TIME ENVIRONMENT TEMPERATURE (C°) | NUMBER OF JOB-A PRINTED PAGES (page) | NUMBER OF JOB-B PRINTED PAGES (page) |
|---|---|---|---|---|---|---|---|
| OPERATION STATUS A | Sa | k1 | Cx1 | Cmax | Cstart | Pa | Pb |
| OPERATION STATUS B | Sb | k2 | Cx2 | | | | |

FIG.16B

| RESULT | PRINT TIME (min) |
|---|---|
| WITH PERMUTATION | t5 |
| WITH COOLING | t6 |

TEMPERATURE CONTROL IN IMAGE FORMING APPARATUS

BACKGROUND OF THE INVENTION

1. Field of the Invention

The present invention relates to a temperature control method in image forming apparatuses, such as copying machines, and laser printers.

2. Description of the Related Art

Heretofore, in the image forming apparatuses, temperature rise suppression control has been implemented not to give rise to image defects due to temperature elevation, in other words, to form good images on a recording medium even if the interior temperature rises during an image forming operation. For example, as discussed in Japanese Patent Application Laid-Open No. 6-194921, a control system is installed to control the apparatus to temporarily stop the image forming operation when the internal temperature reaches a predetermined temperature level, and a cooling operation takes place to reduce the temperature in the apparatus, and after the temperature is cooled to some extent, the image forming operation is resumed.

However, when the image forming operation is stopped temporarily for the purpose of cooling, a drop in throughput accrues. In this respect, Japanese Patent Application Laid-Open No. 2005-156758 proposes an image forming apparatus configured such that when a temperature reaches a level at which the image forming operation is to be changed, cooling is performed in such a manner that the image forming time will be as short as possible on the basis of a number of images yet to be printed and a temperature change rate based on the apparatus's interior temperature detected at that time.

In this conventional technology, however, in the control method that changes the operation to another stage after a fixed temperature for a change of operation is reached, no consideration has been given to controlling the image forming operation until the temperature rises to a level for a change of operation. In other words, if the image forming operation can be controlled before the interior temperature rises to the level for a change of operation, it is possible to shorten the image forming time more than when controlling the image forming operation after the interior temperature has reached the level for operation change. There is also a room for improvement in control of the image forming operation at a stage before the temperature rises to a level for a change of operation.

SUMMARY OF THE INVENTION

The invention in the present patent application is directed to a method of appropriately controlling an image forming operation to reduce the drop in throughput as far as the interior of the image forming apparatus does not rise to an upper-limit temperature.

According to an aspect of the present invention, an image forming apparatus includes a reception unit, an image forming unit, a drive unit, a detection unit, a prediction unit, and a control unit. The reception unit receives image information to form an image and the image forming unit forms an image based on the image information. The drive unit controls a drive of the imaging forming unit and the detection unit detects temperature within the image forming apparatus. The prediction unit predicts a transition of temperature within the image forming apparatus and an image formation time based on the image information and the temperature within the image formation unit. The control unit switches to either a first image forming mode or a second image forming mode. In the first image forming mode, a formation of an image is performed in such a manner as the drive of the image formation unit is decelerated to prevent the temperature within the image forming apparatus from reaching an upper limit temperature. In the second image forming mode, the image formation by the image formation unit is interrupted when the temperature within the image forming apparatus reaches the upper limit temperature and then the image formation is resumed. The prediction unit predicts a first image forming time when the first image forming mode is executed and a second image forming time when the second image forming mode is executed. Moreover, the control unit controls the image forming apparatus to form an image in an image forming mode that takes a short image forming time based on the image forming time predicted by the prediction unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIGS. 8A and 8B are tables illustrating examples of printing conditions in the first exemplary embodiment of the present invention.

FIGS. 10A and 10B are tables illustrating examples of printing conditions in the first exemplary embodiment of the present invention.

FIG. 13 indicates diagrams illustrating permutation of jobs according to a second exemplary embodiment of the present invention.

FIGS. 16A and 16B are tables illustrating an example of printing conditions according to the second exemplary embodiment of the present invention.

DESCRIPTION OF THE EMBODIMENTS

Various exemplary embodiments, features, and aspects of the invention will be described in detail below with reference to the drawings. The following embodiments are not intended to limit the invention described in the claims thereof, and all combinations of characteristic features described in the embodiments are not necessarily essential to the solving means of the invention.

Figure 1:
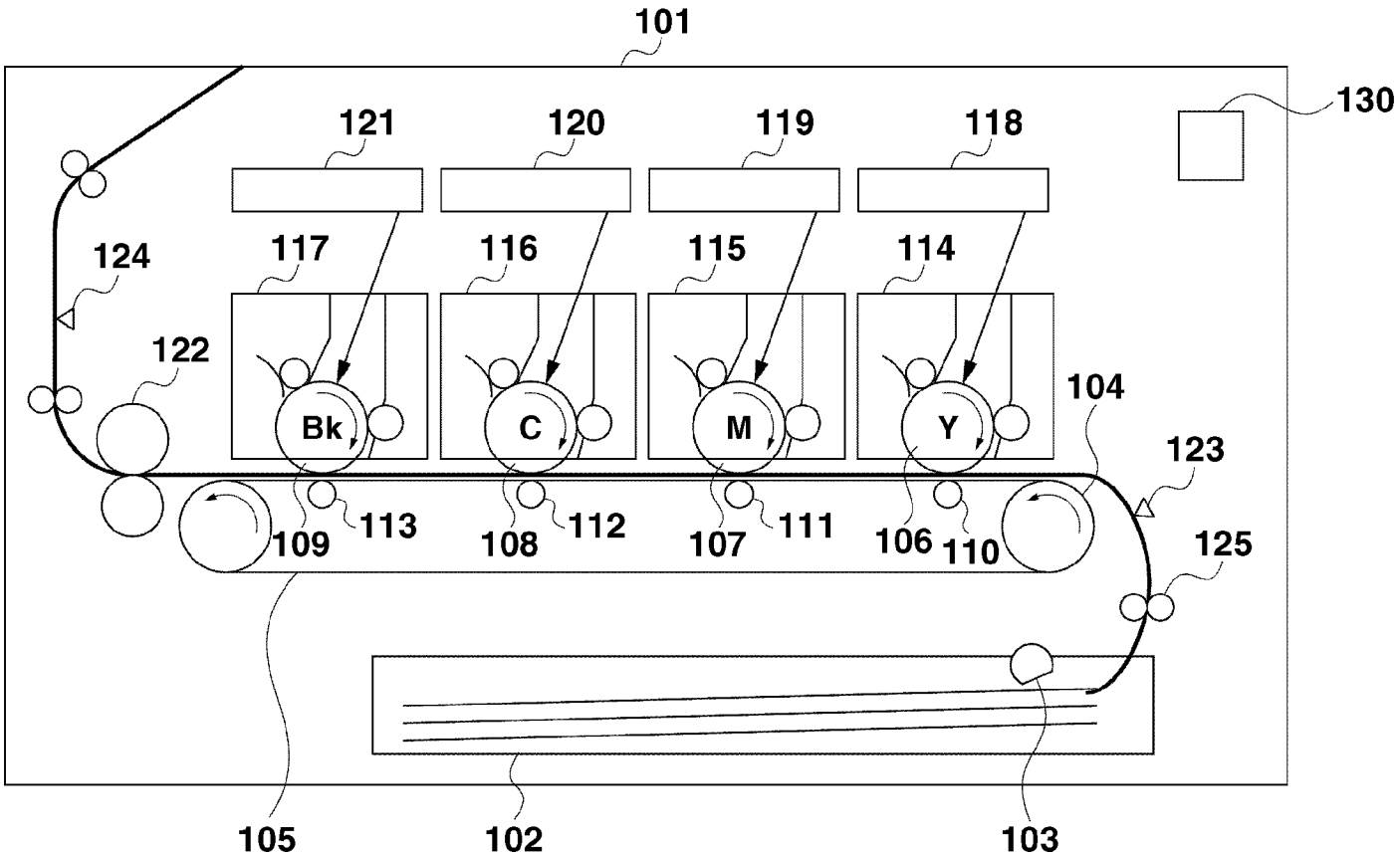
FIG. 1 is a schematic cross section of an image forming apparatus.

FIG. 1 is a schematic diagram of an image forming apparatus 101 according to a first exemplary embodiment of the invention. A sheet feed tray 102 contains recording medium. A sheet feeding roller 103 picks up a recording medium from the sheet feed tray 102. A drive roller 104 drives a transfer belt 105. Photosensitive drums 106 to 109 have images formed on their surfaces, and transfer rollers 110 to 113 transfer the images on the photosensitive drums to a recording medium. Cartridges 114 to 117 each accommodate a toner container containing a toner to form an image, and a developing roller to develop the photosensitive drum.

Optical units 118 to 121 each work to form a latent image on the photosensitive drum. The respective optical units 118 to 121 of respective colors form latent images by scanning the surfaces of the photosensitive drums 106 to 109 with a laser beam. The developing rollers 114 to 117 form visible images of different colors on the photosensitive drums. A series of those operations are controlled in synchronism with each other so that the images are transferred to predetermined positions on a recording medium being transferred. The images developed on the photosensitive drums are transferred by the transfer rollers to the recording medium. A fixing unit 122 fixes the image transferred to the recording medium by the transfer rollers.

The image forming apparatus 101 includes an environment sensor 130 configured to detect a temperature in the image forming apparatus. The environment sensor 130 is mounted in a position where it is not subjected too much to the heat generated by the driving devices, such as motors for sheet feed or image transfer. The temperature detected by the environment sensor 130 is monitored by the control unit in the image forming apparatus.

Figure 2:
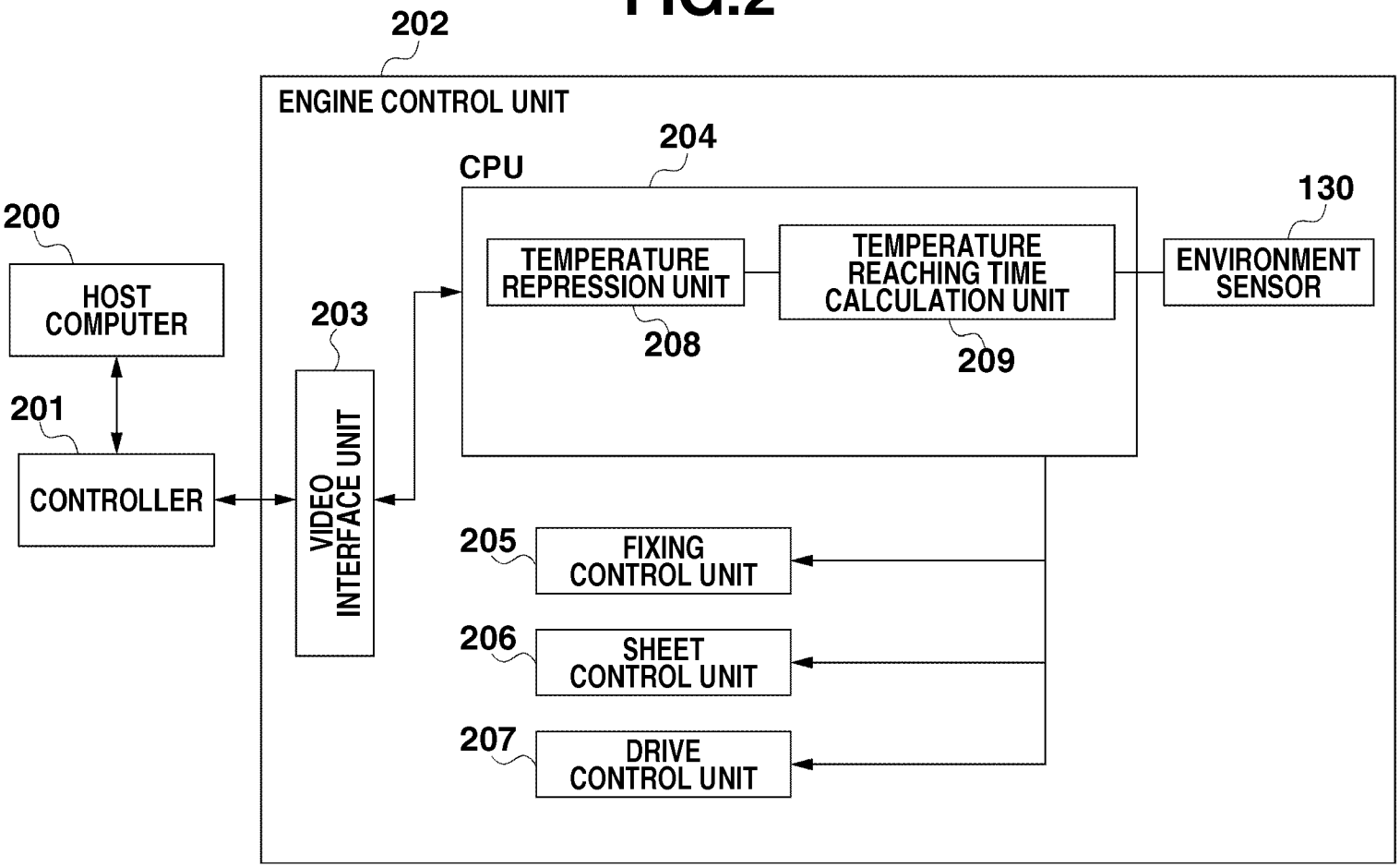
FIG. 2 illustrates a schematic block diagram of the image forming apparatus.

FIG. 2 is a block diagram illustrating a system configuration of the image forming apparatus 101. A host computer 200 transmits image information to a controller 201. The controller 201 can communicate with the host computer 200 and an engine control unit 202. The controller 201, via a video interface unit 203, transmits image forming reservation information to which print speed, kinds of a sheet feed port and a recording medium, a recording medium size, a image forming mode, a number of sheets to be printed at each print job and so on, are added, to the engine control unit 202 according to image information received from the host computer 200.

The video interface unit 203 receives signals transmitted from the controller 201 to the engine control unit 202, and sends to the controller 201 data on the status of the image forming apparatus and a signal requesting for image information.

When receiving image forming reservation information at the video interface unit 203, a CPU 204 of the engine control unit 202 predicts a temperature in the image forming apparatus after an image is formed, using a temperature reaching time calculation unit 209, based on a temperature in the image forming apparatus detected by the environment sensor 130 and reservation information. A temperature repression unit controls a fixing control unit 205, a sheet conveyance unit 206, and a drive control unit 207 to prevent the temperature in the image forming apparatus from becoming higher than an upper limit temperature. A concrete temperature prediction method and a control method of cooling the image forming apparatus will be described later.

Figure 3:
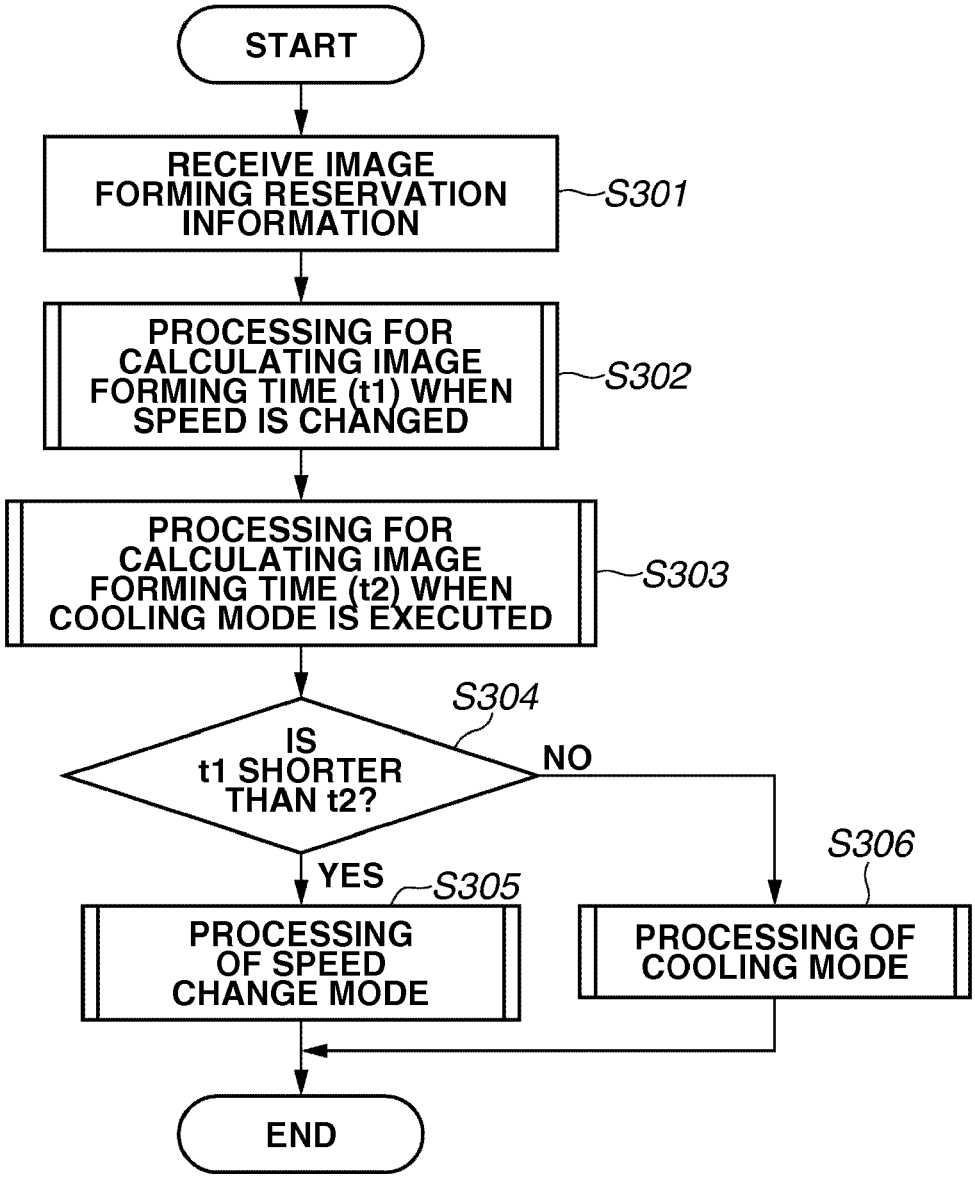
FIG. 3 is a flowchart illustrating an image forming operation according to a first exemplary embodiment of the present invention.
Figure 7:
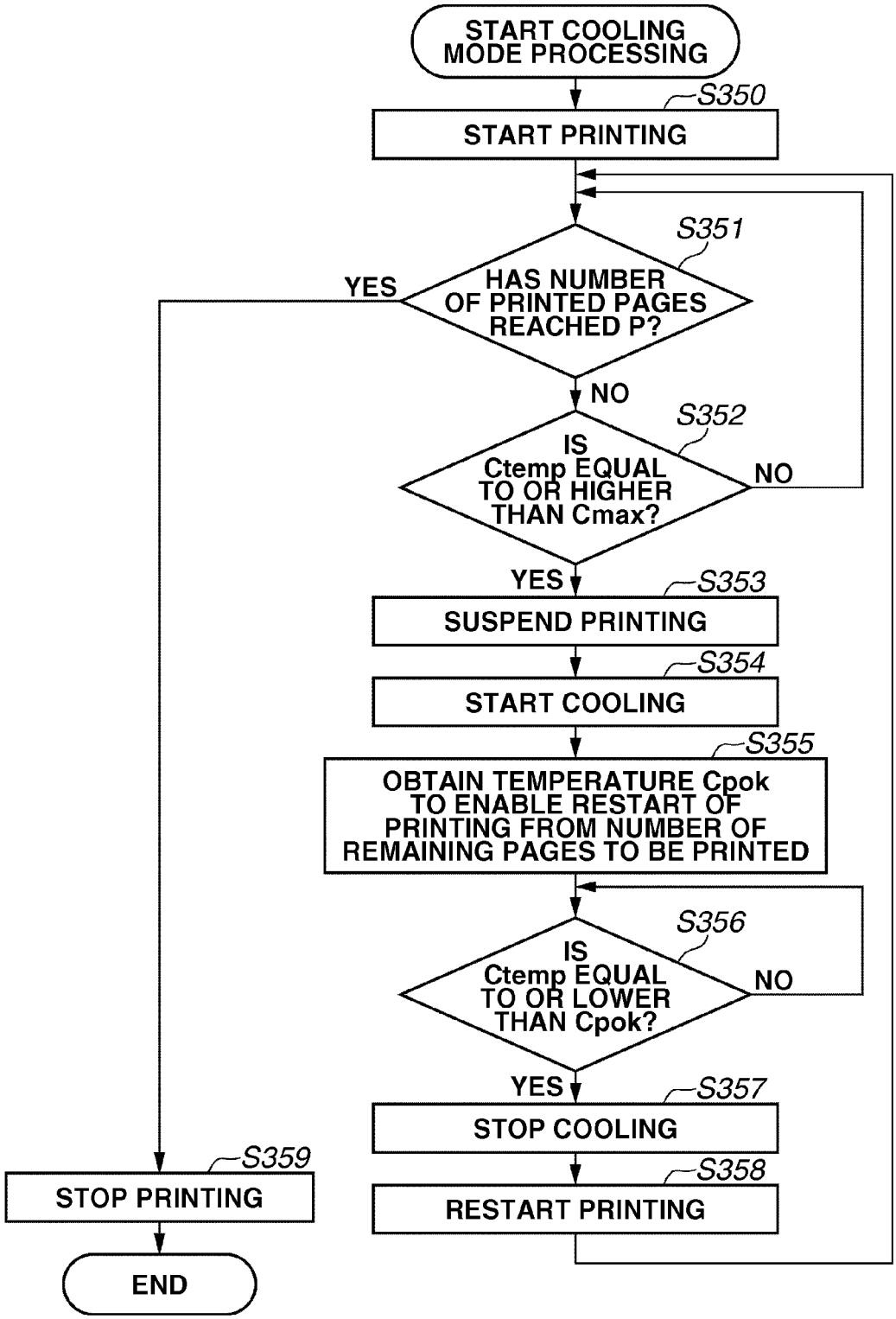
FIG. 7 is a flowchart illustrating an operation in a cooling mode according to the first exemplary embodiment of the present invention.

Referring to FIGS. 3 and 7, a method of predicting the temperature in the image forming apparatus and a control method of controlling image formation to prevent the temperature from going over an upper limit temperature according to the present exemplary embodiment will be described. By using the flowchart in FIG. 3, a flow of a series of operations from when image formation reservation information is received until the end of image formation will be described.

In step S301, image forming reservation information is received from the controller 201. In step S302, an image forming time (hereafter referred to as t1) is calculated when a speed change mode is executed to change the speed in the middle of a job to prevent the temperature from reaching the upper limit temperature (hereafter referred to as Cmax). How to calculate t1 will be described in detail later. In step S303, an image forming time (hereafter referred to as t2) is calculated when a cooling mode is executed to perform cooling by a cooling device, for example, by temporarily interrupting the image formation operation to prevent the interior temperature of the image cooling apparatus from reaching Cmax. How to calculate t2 will be described in detail later.

In step S304, a comparison is made between time t1 obtained as described when image formation is performed by executing a speed change mode as a first image forming mode in the middle of the job, and a time t2 when image formation is performed by executing a cooling mode as a second image forming mode. If the time t1 is shorter, in step S305, the image formation is performed by using the speed change mode in the middle of the job, or if the time t2 is shorter, in step S306, the image formation is performed by using the cooling mode. These two modes will be described in greater detail later.

Figure 4:
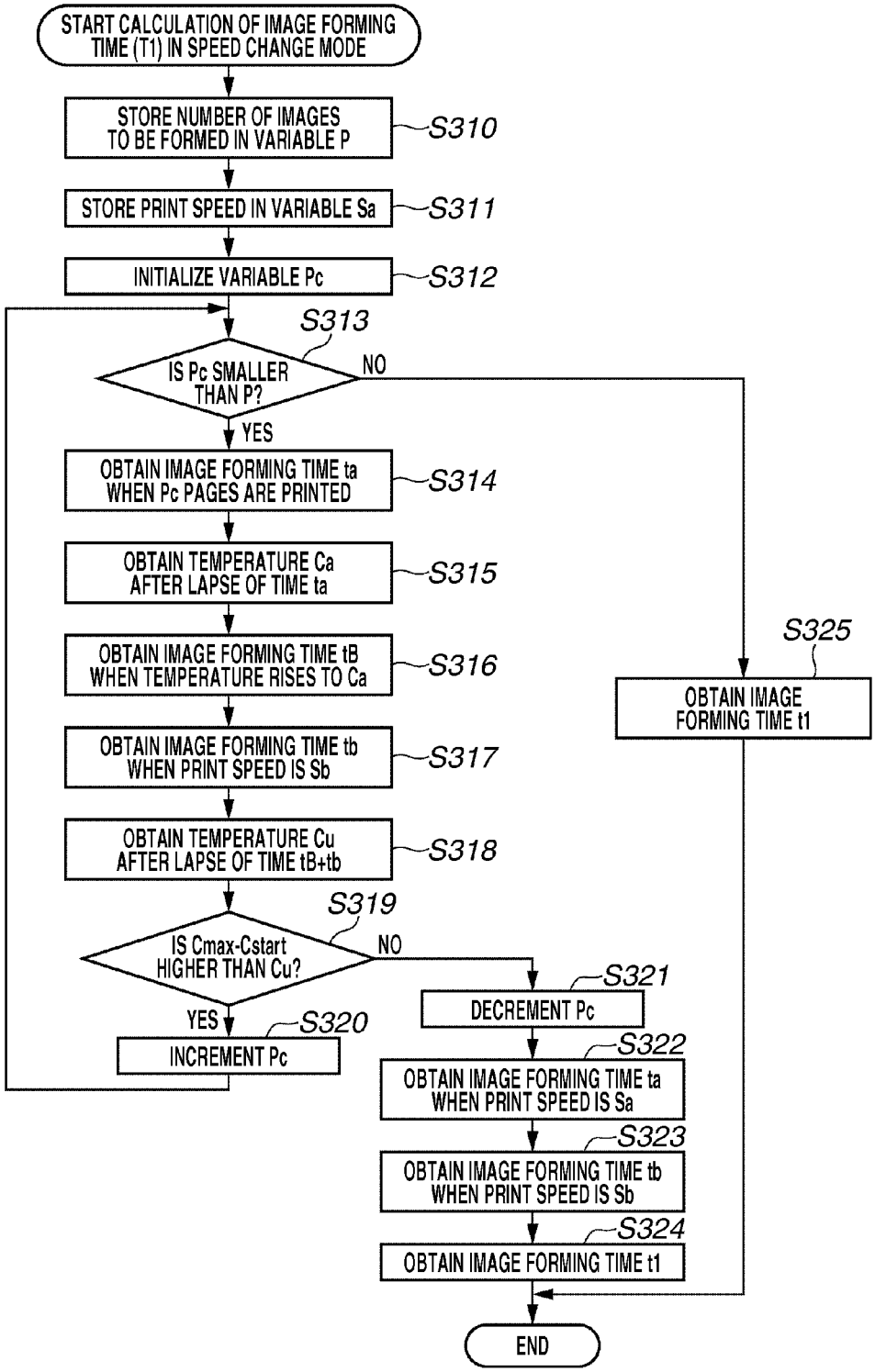
FIG. 4 is a flowchart illustrating a method of calculating an image forming time when a speed change mode is executed.

Referring to the flowchart in FIG. 4, a calculation method of the image forming time t1 in the speed change mode will be described. In step S310, a number of images to be formed in each print job is stored in the variable P. In step S311, a print speed Sa in each print job is stored in the variable Sa. In step S312, the variable Pc that stores a number of pages on which images are formed at a print speed Sa is initialized. In step S313, a number of pages Pc to be printed at the print speed Sa and a number of pages P in each print job of recording medium are compared.

In step S313, if Pc is smaller than P, in step S314, an image forming time to in which the number of pages Pc are printed at the print speed Sa is calculated by equation (1).

$$Ta=Pc/Sa \quad (1)$$

Then, an estimated temperature when the number of pages Pc are printed is calculated. The estimated temperature is calculated by using equation (2) as follows.

$$C(t)=Cx\times(1-(1-k)^{t}) \quad (2)$$

In this equation (2), t is time, and C(t) is a temperature at time t. Cx is a value inherent to the operation status and is a temperature that finally converges as t increases. k is a value inherent to the operation status and is a real number between 0 and 1.

In step S315, from equation (2), printing is performed by using a finally converging temperature Cx1 at the print speed Sa and k1, and a temperature Ca that rises from the start of printing until after a lapse of to is calculated as follows.

$$Ca=Cx1-Cx1\times(1-k1)^{ta} \quad (3)$$

By solving the equation (2) for time t, time t from the start of printing till a temperature rise of C° C. can be obtained.

$$t=\log(1-k)|1-C/Cx| \quad (4)$$

In step S316, from equation (4), image formation is performed by executing a speed change using a finally converging temperature Cx2 and k2 at a print speed Sb ("Sa>Sb", and "a temperature rise trend of Sa is higher than a temperature rise trend of Sb"). After the image formation processing, an image forming time tB at a print speed Sb when the temperature rises until it reaches Ca is calculated as follows.

$$tB=\log(1-k2)|1-C/Cx2| \quad (5)$$

In step S317, an image forming time tb elapsing after the print speed is changed to the print speed Sb and the temperature reaches Ca until the end of the print job is calculated as follows.

$$Tb=(P-Pc)/Sb \quad (6)$$

In step S318, by equation (2), a temperature Cu after a lapse of tB+tb is calculated as follows.

$$Cu=Cx2-Cx2\times(1-k2)^{(tB+tb)} \quad (7)$$

In step S319, the temperature at the start of printing is detected by a detection device, such as a temperature sensor and this temperature is taken as Cstart. The Cu calculated in step S318 and (Cmax−Cstart) as a difference between the temperature at the start of printing and the upper-limit temperature are compared. In step S319, if the Cu is lower, in step S320, the Pc is incremented. The steps from step S313 to step S319 are repeated until the Pc is larger than P or the Cu is larger than (Cmax−Cstart).

In step S319, if the Cu is higher, in step S321, the Pc is decremented. In step S322, an image forming time ta when Pc pages are printed at a print speed Sa is obtained as follows.

$$Ta=Pc/Sa \quad (8)$$

In step S323, an image forming time after the print speed is changed to Sb till the end of the print job is calculated as follows.

$$tb=(P-Pc)/Sb \quad (9)$$

An image forming time t1 when the print speed is changed to prevent the temperature from reaching Cmax is calculated according to a sum of ta and tb obtained in steps S322 and S323 by using an equation as follows.

$$T1=ta+tb \quad (10)$$

In step S313, if Pc>P, an image forming time t1 when P pages are printed at a print speed Sa is calculated as follows.

$$T1=P/Sa \quad (11)$$

Figure 5:
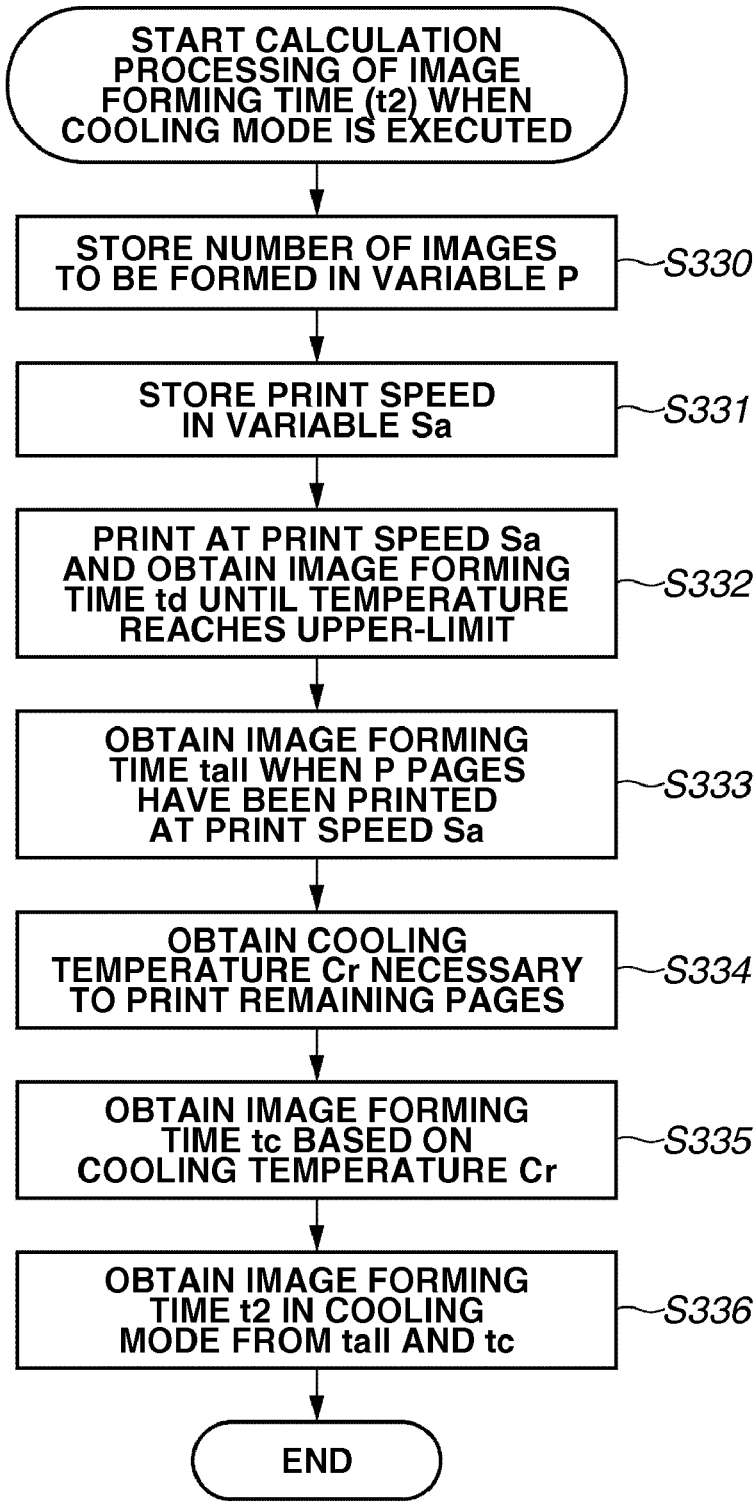
FIG. 5 is a flowchart illustrating a method of calculating an image forming time when a cooling mode is executed according to the first exemplary embodiment of the present invention.

Referring to the flowchart in FIG. 5, a method for calculating an image forming time t2 when a cooling mode is executed will be described. In step S330, a number of pages to be printed in each print job are stored in the variable P. In step S332, a print speed for each print job is stored in the variable Sa. An image forming time td from the start of printing at a print speed Sa until the temperature reaches the upper limit temperature Cmax is calculated by $$td=\log(1-k1)|1-(Cmax/Cstart)/Cx1| \quad (12)$$

In step S333, an image forming time tall when P pages of a print job are printed at a print speed Sa is calculated by:

$$tall=P/Sa \quad (13)$$

In step S334, a cooling temperature Cr, which is necessary until printing of a number of pages remaining at a time when Cmax is reached is completed, is calculated by using td, tall, and the equations (2) and (4) as follows.

A temperature rise Cd after a lapse of td is calculated by using equation (1), as expressed below.

$$Cd=Cx1-Cx1\times(1-k1)^{td} \quad (14)$$

A temperature rise Call after a lapse of tall by using equation (1), as expressed below.

$$Call=Cx1-Cx1\times(1-k1)^{tall} \quad (15)$$

The Cr is calculated by using Cd and Call, as expressed below.

$$Cr=Call-Cd \quad (16)$$

In step S335, time tc required for cooling in step S334 is calculated by equation (17) by using the calculated Cr, a temperature counter value that finally converges during cooling (hereafter referred to as Cx3), and k3.

$$tc=\log(1-k3)|1-Cr/Cx3| \quad (17)$$

In step S336, printing is performed at a print speed Sa from a sum of tall and tc, and an image forming time t2 in which the cooling mode is executed is calculated as follows.

$$t2=Tall+tc \quad (18)$$

Figure 6:
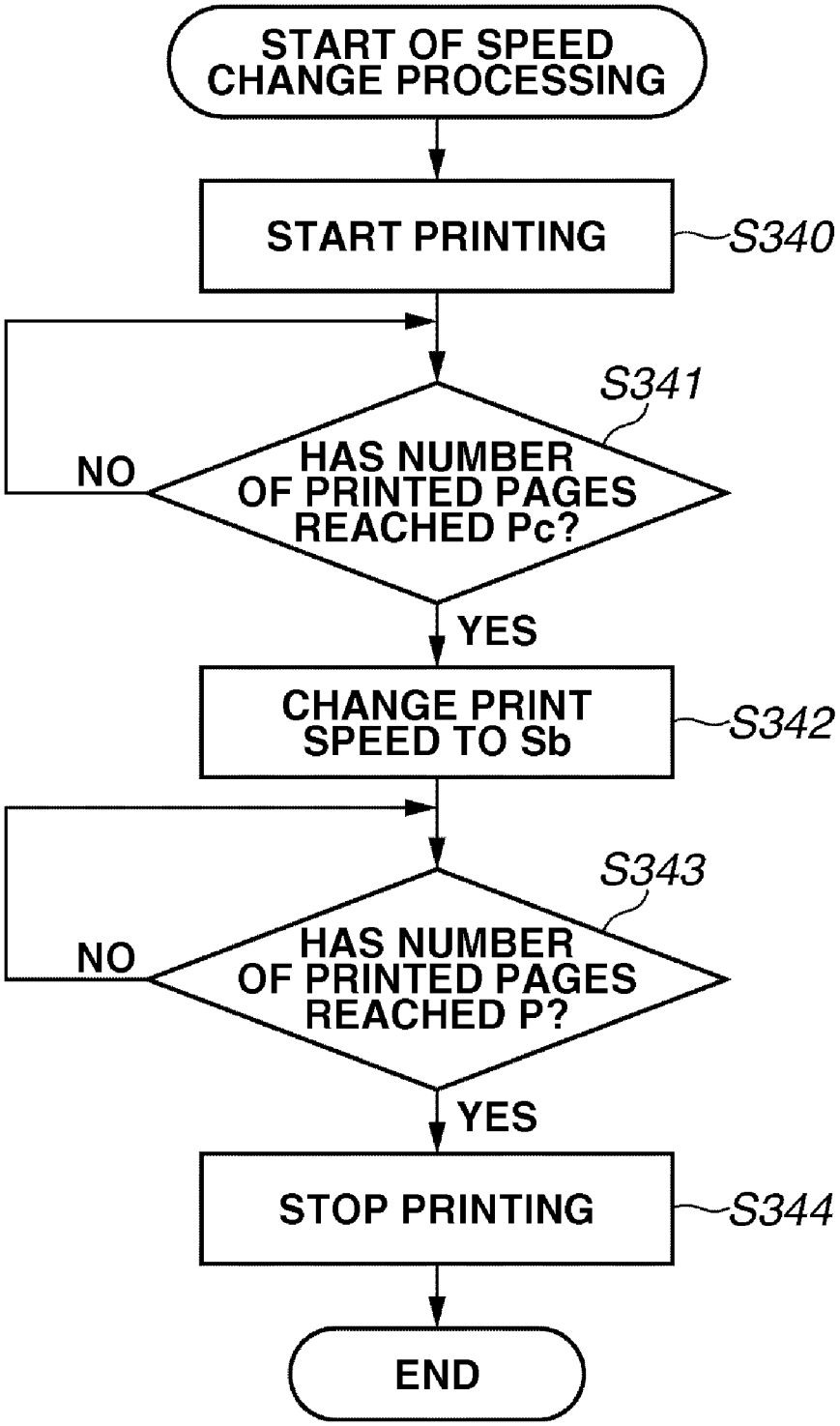
FIG. 6 is a flowchart illustrating an operation in a speed change mode according to the first exemplary embodiment of the present invention.

Using the flowchart in FIG. 6, a method of changing the print speed will be described. In step S305 in FIG. 4, when the speed change mode is executed, in step S340, printing is started. In step S341, the number of pages is counted until the number of recording medium pages reaches Pc pages. When the number of printed pages reaches Pc pages, in step S342, the print speed is changed from Sa to Sb. At this time, a relation holds that Sa>Sb (Sa is faster than Sb and the temperature rise trend of Sa is higher than the temperature rise trend of Sb). By reducing the print speed, the temperature rise can be made more gradual.

In step S343, the number of printed pages is counted until the number of printed pages of recording medium reaches P pages. When the number of printed pages reaches P pages, in step S344, printing is finished. Using the flowchart of FIG. 7, a method of executing the cooling mode will be described. When the cooling mode is executed in step S306 of FIG. 4, in step S350, printing is started. In step S351, the number of printed recording medium pages is counted, and if the number of pages has not reached P pages, in step S352, it is determined whether the environment temperature Ctemp measured by the environment sensor 130 has reached Cmax, the upper limit temperature. If Cmax has not been reached, the processing returns to step S351, and the number of printed pages is counted again. When Ctemp reaches Cmax, in step S353, printing is suspended temporarily. In step S354, the cooling mode is started. In the cooling mode according to this exemplary embodiment of the present invention, printing is temporarily suspended until the apparatus interior cools down to a temperature at which printing can be started. However, other cooling methods can also be used, such as a cooling fan, for example.

In step S355, Cr is calculated from the number of pages to be printed, and a printable temperature Cpok is calculated from a difference between Cmax and Cr. In step S356, if Ctemp is not yet cooled down to Cpok, the cooling mode is continued. When Ctemp is cooled down to Cpok, in step S357, the cooling mode is stopped. In step S258, printing is resumed and the processing returns to step S351. In step S351, when the number of printed recording medium pages reaches P pages, in step S359, printing is finished.

Using FIGS. 8 to 11, changes in the image forming time and the temperature rise will be described when the cooling mode is executed and when the speed change mode is used. Referring to FIGS. 8 and 9, a case is illustrated in which the image forming time is shorter when the speed change is carried out. Print conditions are set as indicated in FIG. 8A.

In an operation status A, printing is performed under conditions of a print speed Sa [pages/min], a coefficient k1, and a finally converging temperature Cx1 [° C.]. In an operation status B, printing is performed under conditions of a print speed Sb [pages/min], a coefficient k2, and a finally converging temperature Cx2 [° C.]. In both the operation statuses A and B, the temperature rise limit is Cmax [° C.], the print start-time environment temperature is Cstart [° C.], and P1 pages are printed. The print speeds Sa and Sb, k1, k2, Cx1, and Cx2 are values inherent to an image forming apparatus used, and relations, Sa>Sb, k1>k2, and Cx1>Cx2 should hold.

FIG. 8B illustrates image forming time by printing performed when the speed change mode is used and when the cooling mode is used. In this case, the image forming time is t1(min) when the speed change mode is used, and t2(min) when the cooling mode is used. Since t1 is shorter than t2 (t1<t2), the speed change mode provides a shorter image forming time than the cooling mode.

Figure 9A:
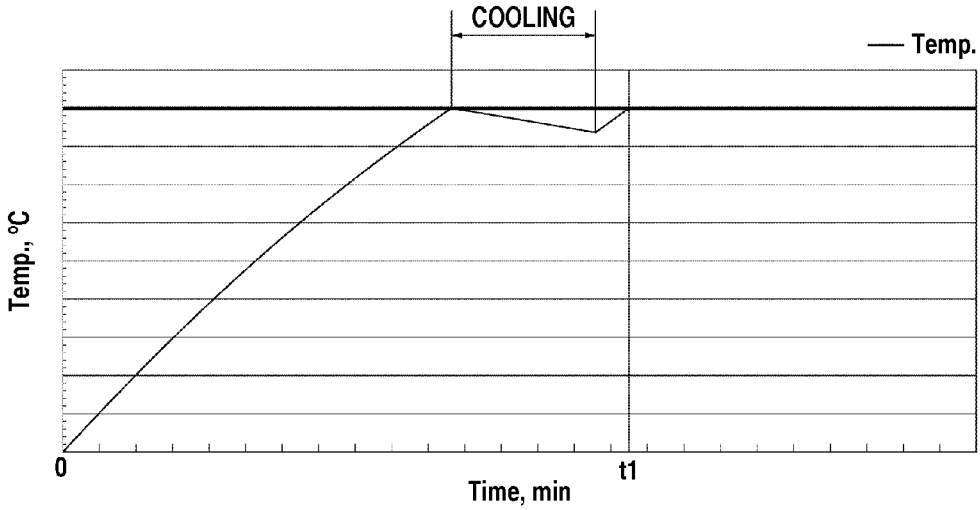
FIGS. 9A and 9B are graphs illustrating relations between image forming time and temperature rise when a speed change mode is executed and a cooling mode is executed according to the first exemplary embodiment of the present invention.
Figure 9B:
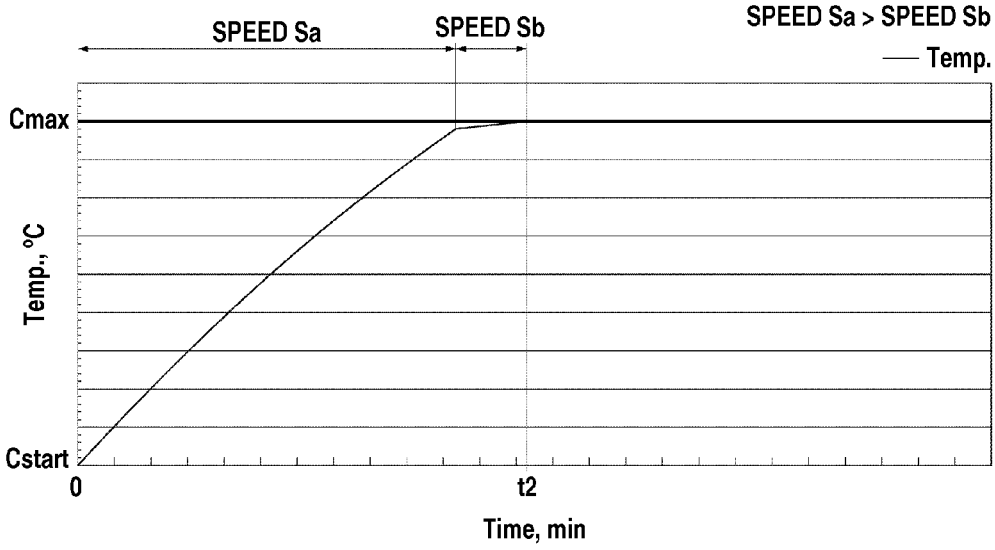

FIGS. 9A and 9B are graphs illustrating changes in the image forming time and the temperature rise. FIG. 9A is a graph indicating control performed to execute the cooling mode when the apparatus's interior temperature reaches the upper-limit temperature, and to resume printing when the interior temperature is cooled down to a temperature at which printing of unprinted pages can be completed. FIG. 9B is a graph illustrating control which, when the interior temperature becomes high, decreases the print speed to reduce the rise rate of the interior temperature though the image forming time becomes longer. FIGS. 9A and 9B are drawn on the same scale. This example indicates that the use of the speed change mode shortens the total image forming time.

With reference to FIGS. 10 and 11, a case will be discussed where the execution of the cooling mode shortens the image forming time. The print conditions are set as indicated in FIG. 10A.

In the operation status A, printing is performed under conditions of a print speed Sa [pages/min], a coefficient k1, and a finally converging temperature Cx1 [° C.]. In the operation status B, printing is performed at a print speed Sb [pages/min], a coefficient k4, and a finally converging temperature Cx4 [° C.]. In both the operation statuses A and B, the temperature rise limit is Cmax [° C.], the print start-time environment temperature is Cstart [° C.], and P2 pages are printed. The print speeds Sa and Sb, k1, k4, Cx1, and Cx4 are values inherent to an image forming apparatus used, and relations, Sa>Sb, k1>k4>k2, and Cx1>Cx4>Cx2 should hold.

FIG. 10B indicates image forming time when the speed change mode is used and when the cooling mode is used. In this example, the image forming time is t3 (min) when the cooling mode is used and t4 (min) when the speed change mode is used. The relation t3<t4 means that the image forming time is shorter in the cooling mode than in the speed change mode.

Figure 11A:
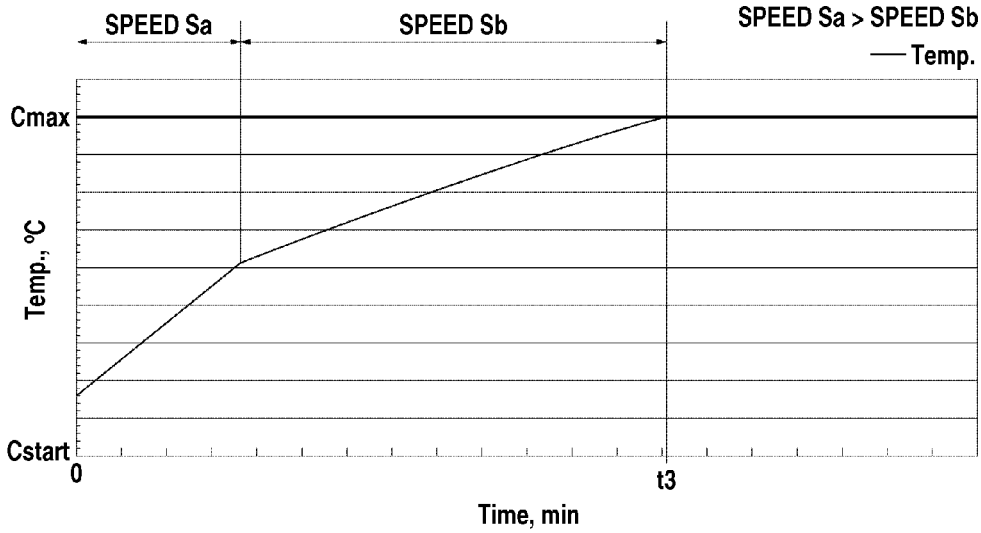
FIGS. 11A and 11B are graphs illustrating relations between image forming time and temperature rise when a speed change mode is executed and a cooling mode is executed according to the first exemplary embodiment of the present invention.
Figure 11B:
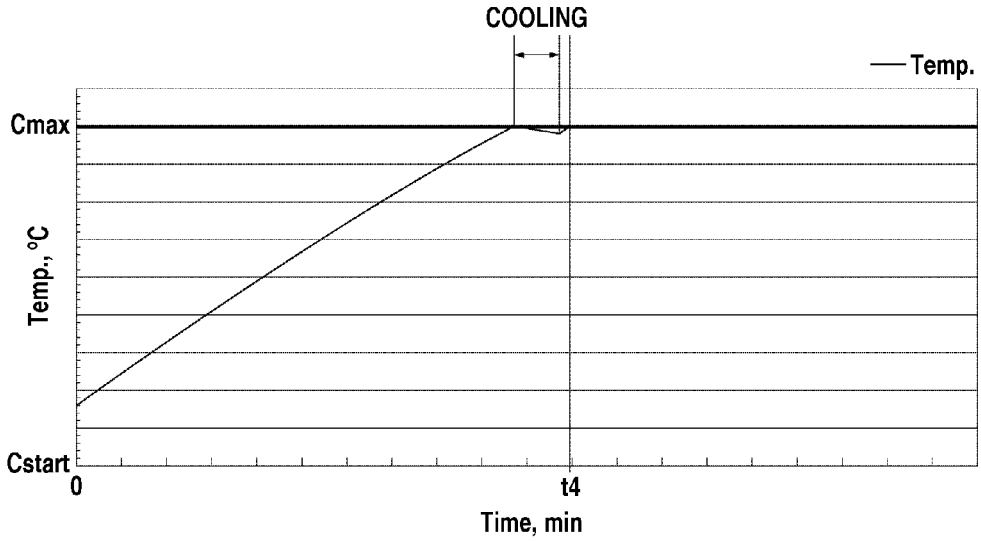

FIGS. 11A and 11B are graphs indicating changes in the image forming time and the temperature rise. FIG. 11A illustrates control which executes the cooling mode when the interior temperature of the apparatus reaches an upper limit of the temperature rise, and resumes printing when the interior temperature cools down to a temperature at which printing of the remaining pages can be completed. FIG. 11B illustrates control which reduces the print speed when the interior temperature becomes higher, and decreases a rise rate of the interior temperature of the apparatus though the image forming time becomes longer. FIGS. 11A and 11B are drawn on the same scale. In this example, it is obvious that the use of the cooling mode makes the total image forming time shorter. In FIGS. 8A, 8B to 11A and 11B, the image forming time in the cooling mode and in the speed change mode are compared, but the two modes can be combined in an image forming operation.

The total image forming time can be controlled to shorten its length by switching a period of cooling and the cooling mode according to the performance of each image forming apparatus and the print conditions, such as the environment temperature at the start of printing, and a number of print jobs.

A second exemplary embodiment of the present invention will be described below. Because this second exemplary embodiment includes many structures in common with the first exemplary embodiment described above, these structures are indicated with the same numerals used above, and their descriptions are not repeated here. In the second exemplary embodiment, the fundamental structures are similar to the first exemplary embodiment other than control that permutes the order of print jobs to minimize the image forming time when a plurality of print jobs are received, and therefore their descriptions are not repeated here.

Figures 12A, 12B:
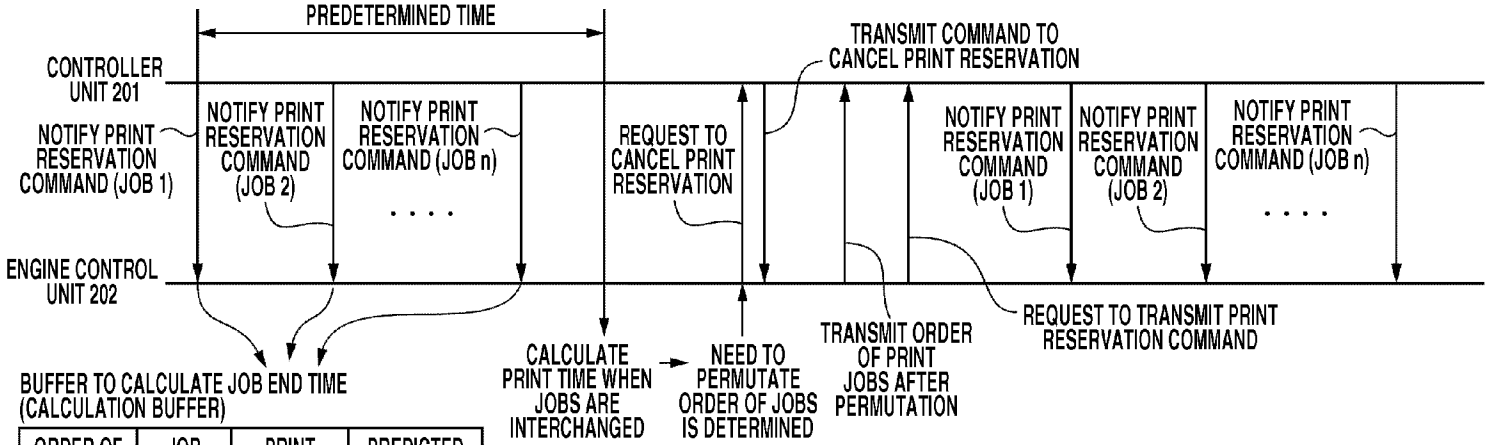
FIGS. 12A and 12B are diagrams illustrating communication between a controller and an engine control unit according to a second exemplary embodiment of the present invention.

Referring to FIG. 12, communication between the controller 201 and the video interface unit 203 of the engine control unit 202 according to the second exemplary embodiment will be described below. The controller 201 transmits a number of print jobs and print speed as print reservation commands to the engine control unit 202 via the video interface unit 203. When receiving the print reservation command, the engine control unit 202 stores print conditions, such as job numbers, a number of jobs, and print speed in a print buffer illustrated in FIG. 12B. The jobs, a print start command of which is received by the engine control unit 202 within a predetermined time, are stored in the print buffer.

When all jobs are stored in the print buffer, a predicted end time of each job is obtained, and a time when all jobs are completed is obtained. Referring to FIG. 13, processing to be performed after the jobs are stored in the print buffer will now be described. An image forming time of all jobs is calculated using equations (2) and (4) used in the first exemplary embodiment, and is stored in a calculation buffer. A printing order of actual print jobs is stored in an execution buffer. If an image forming time based on an order of print jobs stored in the execution buffer is shorter than an image forming time calculated by the calculation buffer, the order of print jobs is replaced by the order of print jobs in the calculation buffer.

The engine control unit 202 cancels a reserving order of print jobs received for the first time from the controller 201, and notifies the controller 201 of a permuted order of print jobs. Then, the engine control unit 202 starts to print jobs in an updated reserving order of print jobs. By permuting a combination of all jobs and deriving a combination of jobs with a shortest image forming time, it becomes possible not only to permute contents in one job but also to adequately control a total image forming time covering all reserved jobs.

Figure 14:
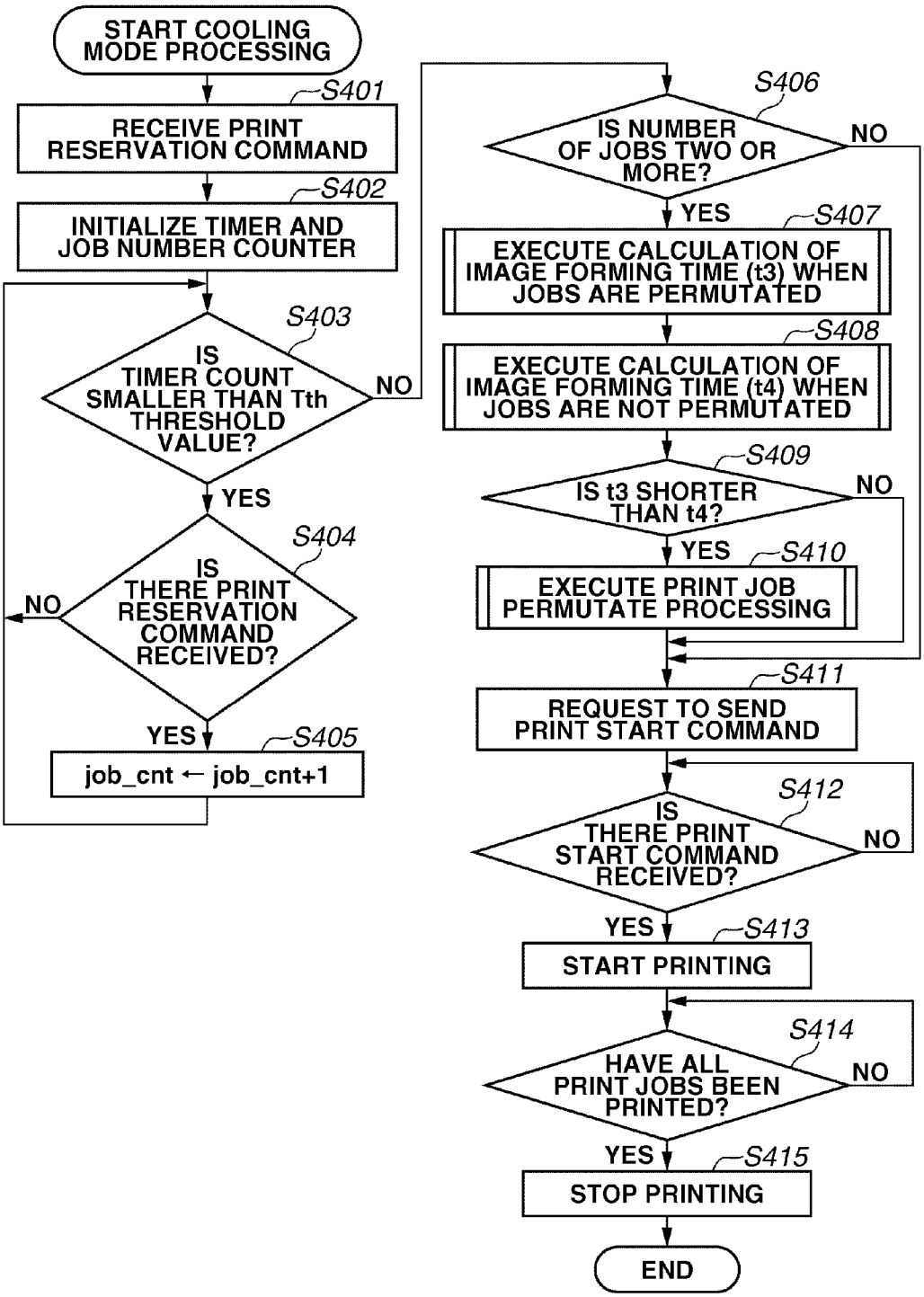
FIG. 14 is a flowchart illustrating a permutation operation of print jobs according to the second exemplary embodiment of the present invention.
Figure 15:
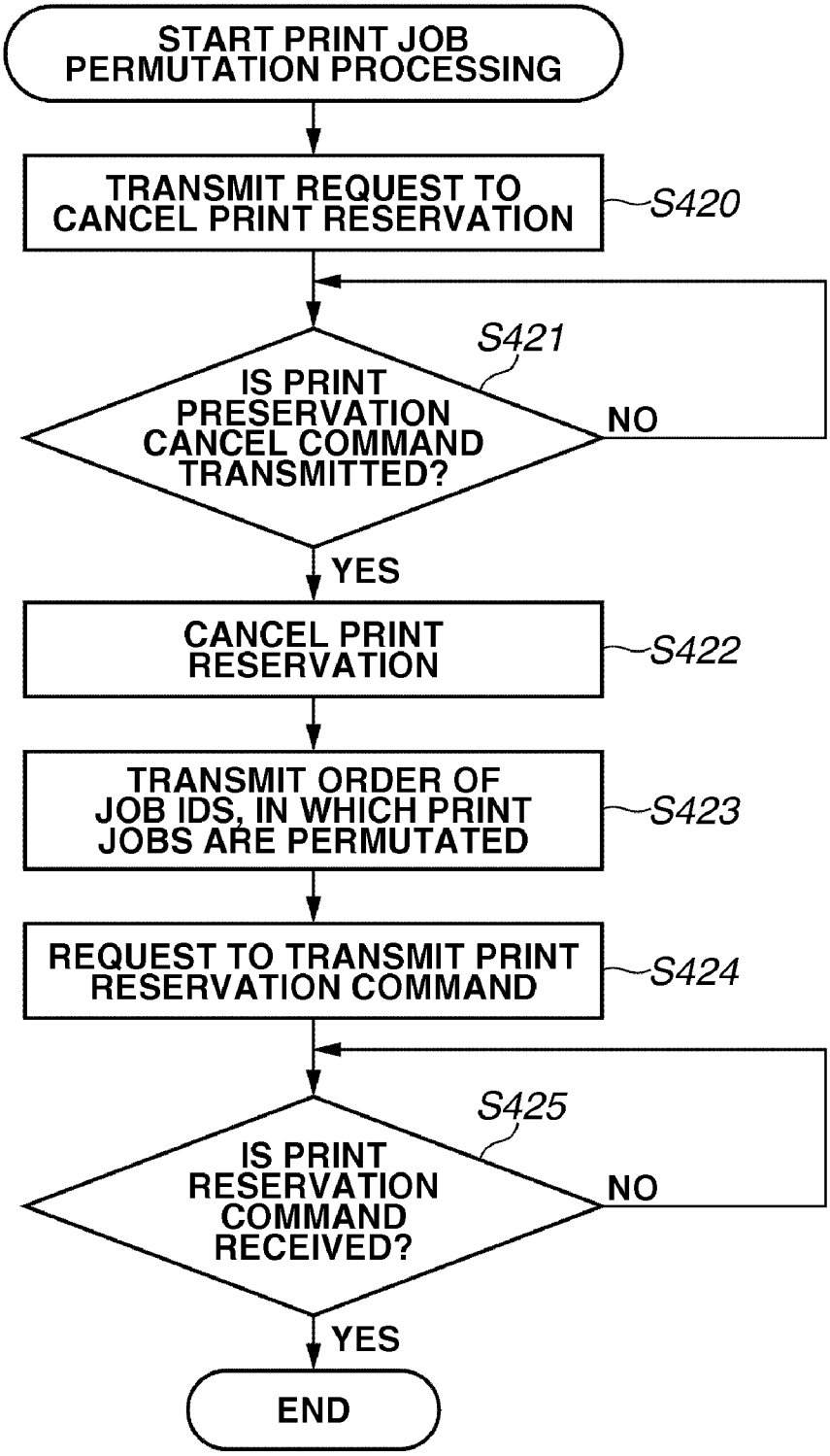
FIG. 15 is a flowchart illustrating communication between the controller and the engine in the permutation operation of print jobs according to the second exemplary embodiment of the present invention.

Referring to FIGS. 14 and 15, as an example, a case where two print jobs are reserved within a predetermined time will be described.

In step S401, the engine control unit 202 receives a print reservation command from the controller 201. In step $02, a timer, which is counted up at a predetermined timing and counts elapsed time (hereafter referred to as a timer), is initialized to 0, and a print job number counter (hereafter referred to as job_cnt) is initialized to 1. In step S403, it is determined whether the timer shows less than an optional threshold value (hereafter referred to as Tth). If the timer is less than the threshold value, in step S404, it is further determined whether there is a print reservation command received. If there is a print reservation command received, in step S405, the job_cnt is incremented by 1, and the processing returns to step S403. If there is not a print reservation command received, the processing returns straight back to the step S403.

In step S403, if it is determined that the timer is larger than Tth, the processing proceeds to step S406. In step S406, it is determined whether the print job number (job_cnt) is 2 or more. If the print job number is 2 or more, in step S407, an image forming time when the order of jobs is permuted (hereafter referred to as t3) is calculated by using equations (2) and (4). Then, in step S308, an image forming time when the order of jobs is not permuted (hereafter referred to as t4) is calculated by using equations (2) and (4).

The method of calculating an image forming time when an order of jobs is permuted and the method of calculating an image forming time when an order of jobs is not permuted both according to this exemplary embodiment are not limited to those methods using equations (2) and (4) Other calculation methods may also be used so long as the methods are able to obtain a total image forming time. For convenience of description, description has been made on condition that there are two patterns of permutation of an order of jobs, but the job permutation methods are not limited to the two patterns, but patterns of combinations, totaling the factorial number N! according to a number N (all jobs) can be applied.

In step S409, t3 and t4 are compared. If t3 is less than t4, the image forming time is shorter when the order of jobs is permuted than when the order of jobs is not permuted. Therefore, in step S410, a permutation processing of print jobs is executed. This print job permutation processing will be described in greater detail with reference to the flowchart in FIG. 15.

When, in step S410, a permutation processing of print jobs is started, in step S420, the image forming apparatus 101 sends the controller a request to cancel a print reservation which has been made. In step S421, the image forming apparatus 101 determines whether there is a print cancel command received from the controller 201.

In step S423, the image forming apparatus 101 sends the controller 201 a sequential order of print jobs, which offers a shortest image forming time, which is calculated in the image forming time calculation processing in step 407. In step 424, after having finished transmitting the order of print jobs, the image forming apparatus 101 requests the controller 201 to retransmit a print reservation command. In step S425, when the image forming apparatus 101 has finished receiving print reservation commands of all permuted print jobs from the controller 201, the permutation of jobs is completed.

In step S411, the image forming apparatus 101 requests the controller 201 to transmit a print start command. In step S412, the image forming apparatus 101 determines whether a print start command is received. Upon receiving a print start command, the image forming apparatus 101, in step S413, starts printing. In step S414, the processing is repeated until it is determined that all print jobs have been printed. When all print jobs have been printed, in step S415, printing is finished.

FIGS. 16A, 16B, 17A, 17B illustrate the image forming time both when the order of print jobs is permuted and when the order of print jobs is not permuted. As a concrete example, a case is illustrated in which the image forming time becomes shorter when the order of print jobs is permuted. The print conditions are set as indicated in FIG. 16A. The jobs are executed in the order of job A to job B, and it is supposed that a start of printing is instructed in a 5 seconds interval. Jobs which are to be permuted are limited to those jobs which have been reserved for printing within 5 seconds from the moment the image forming apparatus receives a print reservation command for the first job. Those jobs which are subjected to permutation are not limited to those which have been reserved within the 5 seconds mentioned above, but this timing can be set freely.

In the operation status A, printing is performed under conditions of a print speed Sa [pages/min], a coefficient k1, and a finally converging temperature Cx1 [° C.]. In the operation status B, printing is performed under conditions of a print speed Sb [pages/min], a coefficient k2, and a finally converging temperature Cx2 [° C.] In both the operation statuses A and B, the temperature rise limit is Cmax [° C.], the print-start environment temperature is Cstart [° C.], and the number of pages is Pa pages in a print job A at a designated print speed of Sa and Pb pages in a print job B at a designated print speed of Sb. The print speeds Sa, Sb, k1, k2, Cx1, Cx2 are values inherent to an image forming apparatus used, and relations, Sa>Sb, k1>k2, Cx1>Cx2, and Pa>Pb should hold.

FIG. 16B illustrates image forming time in performing the printing when the order of the jobs are permuted and when the order of the jobs are not permuted. In this example, the image forming time is t5 (min) when the jobs are permuted and t6 (min) when the jobs are not permuted. More specifically, since t6 is shorter than t6 (t5>t6), the image forming time is shorter when the order of the jobs are permuted than when the order of the jobs are not permuted.

Figure 17A:
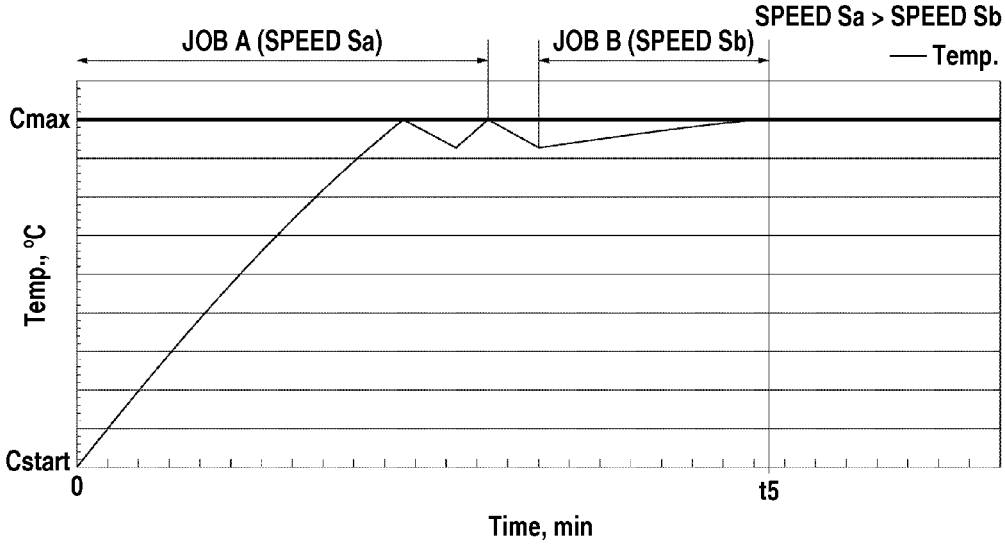
FIGS. 17A and 17B are graphs illustrating relations between the image forming time and the temperature rise when print jobs are permuted and when print jobs are not permuted according to the second exemplary embodiment of the present invention.
Figure 17B:
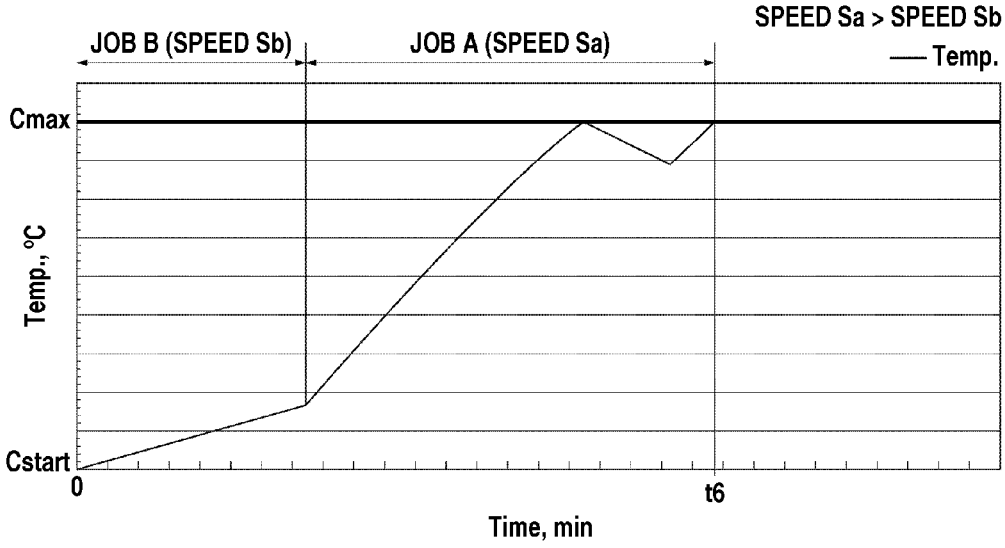

FIGS. 17A and 17B are graphs illustrating changes in the image forming time and the temperature rise. FIG. 17A is a case where printing is performed according to a reserved order, more specifically, the job A is printed and then the job B is printed. FIG. 17B is a case where printing is performed in a permuted order, more specifically, the job B is printed first and then the job A is printed. FIGS. 17A and 17B are drawn on the same scale. It is seen from this example that the use of the speed change mode shortens the total image forming time.

Thus, the total image forming time can be controlled to shorten by permuting the reserved order according to the performance of each image forming apparatus and the print conditions, such as the environment temperature at the start of printing, and a number of print jobs.

A third exemplary embodiment of the present invention will be described below. Because this third exemplary embodiment includes many structures in common with the first exemplary embodiment described above, these structures are indicated with the same numerals used above, and their descriptions are not repeated here. In the third exemplary embodiment, the fundamental structures, other than control that recalculates an image forming time when an actual interior temperature of the apparatus differs from a temperature calculated by the temperature reaching prediction unit in the apparatus, are similar to the first exemplary embodiment, and therefore their descriptions are not repeated here.

Figure 18:
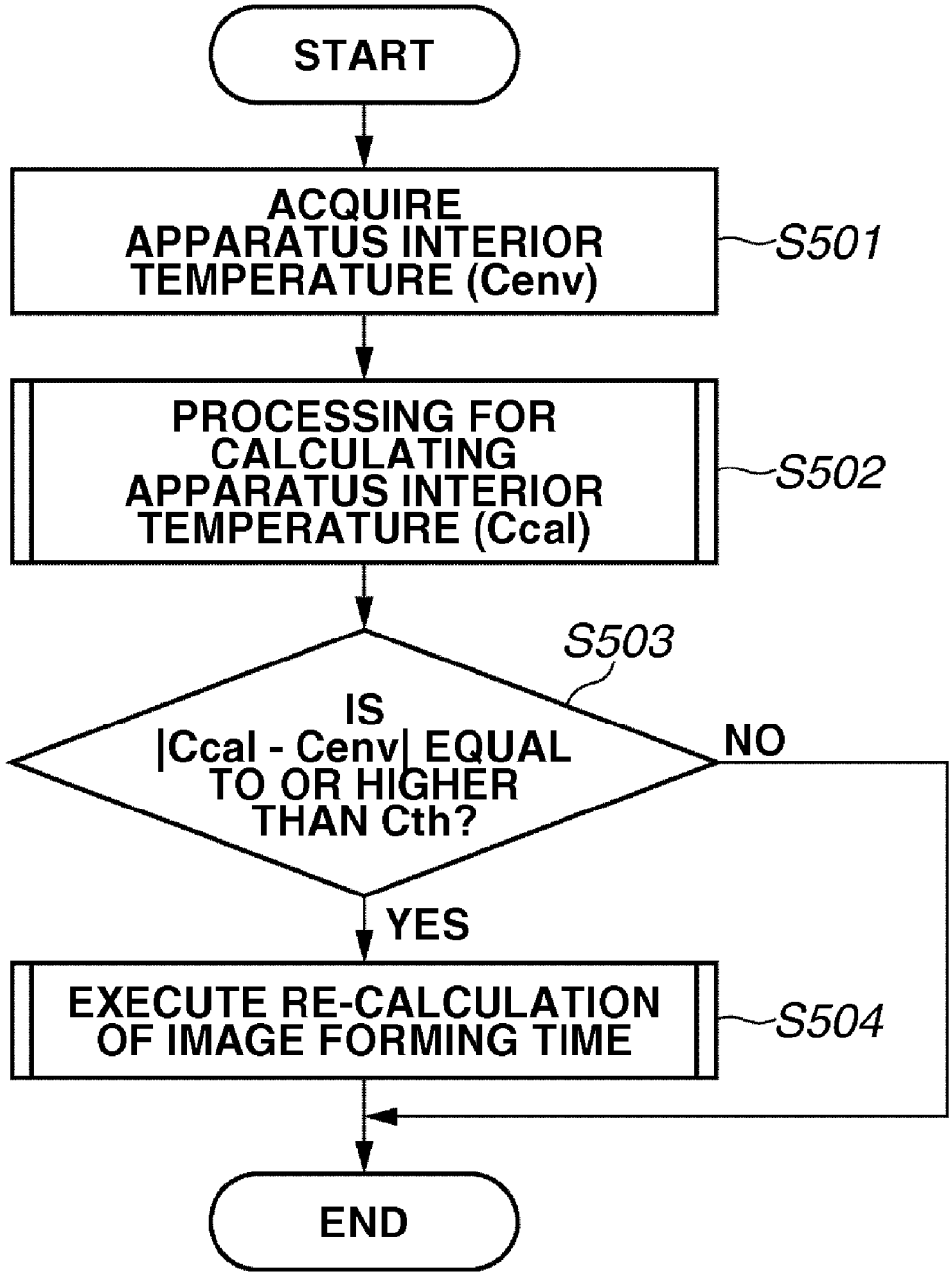
FIG. 18 is a flowchart related to temperature prediction control according to a third exemplary embodiment of the present invention.

Using a flowchart in FIG. 18, control according to the third embodiment of the present invention will be described. Control in the flowchart in FIG. 18 is performed on a steady basis at regular time intervals. The time intervals can be set arbitrarily.

In step S501, a temperature in the apparatus (hereafter referred to as Cenv) after the lapse of a predetermined length of time (tx) from the start of printing is obtained. In step S502, according to Cstart and print conditions designated by the controller 201, the apparatus interior temperature after the lapse of tx (hereafter referred to as Ccal) is calculated in processing for calculating an apparatus interior temperature. The Ccal is calculated by using a print start temperature Cstart, tx, and a finally converging temperature counter value Cx5 and k5 in the designated print conditions as follows.

$$Ccal = Cstart + (Cx5 - Cx5 \times (1 - k5)^{tx}) \quad (19).$$

In step S503, the image forming apparatus determines whether an absolute value of a difference between Ccal and Cenv (|Ccal−Cenv|) is not less than an arbitrary threshold value Cth. In step S503, if it is determined that the absolute value is not less than the threshold value, an error is occurring between an actual temperature and a predicted temperature. In step S504, recalculation is performed in an image forming time recalculation processing, such as the image forming time calculation processing in changing the speed in step S302, the image forming time calculation processing in execution of the cooling mode in step S303, the image forming time calculation processing in permutation of the order of jobs in step S407, or the image forming time calculation processing when permutation of the order of jobs is not performed in step S408.

As described above, by correcting errors between a current temperature and a predicted temperature at predetermined intervals, it becomes possible to improve an accuracy in selecting the control method designed to attain a shortest image forming time.

Other Embodiments

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium). In such a case, the system or apparatus, and the recording medium where the program is stored, are included as being within the scope of the present invention. In an example, a computer-readable medium may store a program that causes image forming apparatus to perform a method described herein. In another example, a central processing unit (CPU) may be configured to control at least one unit utilized in a method or apparatus described herein.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-283457 filed Dec. 14, 2009, which is hereby incorporated by reference herein in its entirety.

What is claimed is:

1. An image forming apparatus comprising:

a reception unit configured to receive image information to form an image;

an image forming unit configured to form an image based on the image information;

a drive unit configured to control a drive of the imaging forming unit;

a detection unit configured to detect temperature within the image forming apparatus;

a prediction unit configured to predict a transition of temperature within the image forming apparatus and an image formation time based on the image information and the temperature within the image formation unit; and a control unit configured to switch to a first image forming mode in which a formation of an image is performed in such a manner as the drive of the image formation unit is decelerated to prevent the temperature within the image forming apparatus from reaching an upper limit temperature, or switch to a second image forming mode in which the image formation by the image formation unit is interrupted when the temperature within the image forming apparatus reaches the upper limit temperature and then the image formation is resumed, wherein the prediction unit predicts a first image forming time when the first image forming mode is executed and a second image forming time when the second image forming mode is executed, and wherein the control unit controls the image forming apparatus to form an image in an image forming mode that takes a short image forming time based on the image forming time predicted by the prediction unit.

2. The image forming apparatus according to claim 1, wherein the reception unit is able to receive a plurality of pieces of image information, and wherein the prediction unit predicts an image forming time when the first image forming time is executed, and an image forming time when the second image forming time is executed, in a case where the plurality of pieces of image formation is all used for image formation.

3. The image forming apparatus according to claim 2, wherein the prediction unit permutes, according to image forming speeds and numbers of images to be formed, an order of images that are based on the plurality of pieces of image information, and predicts an image forming time when the first image forming mode is executed and an image forming time when the second image forming mode is executed.

* * * * *